United States Patent [19]

Oberstadt et al.

[11] 3,990,411

[45] Nov. 9, 1976

[54] CONTROL SYSTEM FOR NORMALIZING THE AIR/FUEL RATIO IN A FUEL INJECTION SYSTEM

[75] Inventors: Alvin Dan Toelle, Fenton; Gene Y. Wen, Troy, all of Mich.

[73] Assignees: Gene Y. Wen, Troy, all of Mich.; The Bendix Corporation, Southfield, Mich.

[22] Filed: July 14, 1975

[21] Appl. No.: 595,455

[52] U.S. Cl. ..... 123/32 EA; 60/276

[51] Int. Cl.[2] ..... F02B 3/00

[58] Field of Search ..... 123/32 EA; 60/276

[56] References Cited

UNITED STATES PATENTS

| | | | |
|---|---|---|---|
| 3,875,907 | 4/1975 | Wessel | 123/32 EA |
| 3,919,983 | 11/1975 | Wahl | 123/32 EA |

*Primary Examiner*—Charles J. Myhre
*Assistant Examiner*—Ronald B. Cox
*Attorney, Agent, or Firm*—Russel C. Wells

[57] ABSTRACT

In a closed loop fuel injection system for an internal combustion engine, a control system responding to several engine operating conditions and to rich fuel power demands operates to normalize the air/fuel ratio to a fixed air/fuel ratio. In the preferred embodiment the system responds to the operating temperature of a gas sensor to effectively remove the influence of the sensor control signals at nonoperational temperature upon the air/fuel ratio developed by the electronic control unit. In addition transducers responding to engine speed, wide open throttle, and coolant temperatures generate control signals to the control system indicating a requirement for engine operation of normalized air/fuel ratio.

9 Claims, 3 Drawing Figures

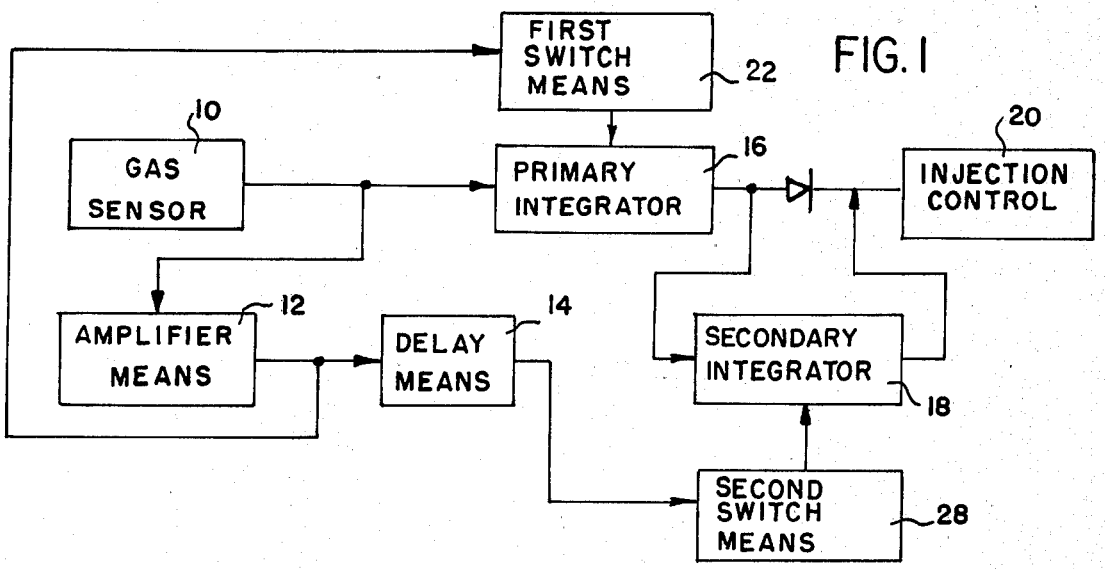
FIG. 1
FIG. 2
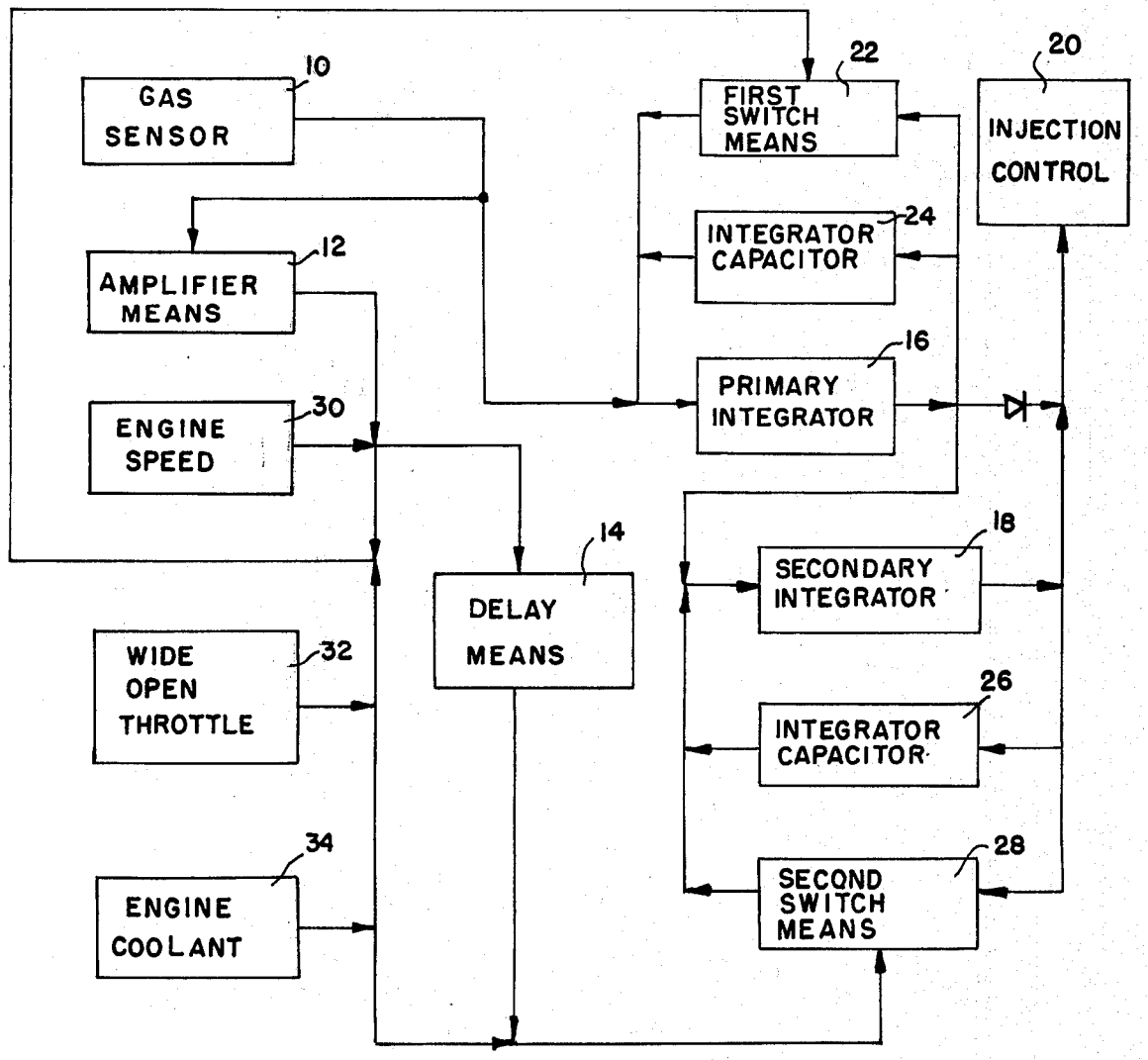

CONTROL SYSTEM FOR NORMALIZING THE AIR/FUEL RATIO IN A FUEL INJECTION SYSTEM

BACKGROUND OF INVENTION

1. Field Of The Invention

This invention relates to a gas sensor operating system in closed loop fuel injection systems and, more particularly, to control systems responding to particular engine operating conditions requiring a fixed predetermined air/fuel ratio.

2. Prior Art

The basic closed loop control fuel injection system for motor vehicles having internal combustion engines utilizes an oxygen gas sensor responding to the amount of oxygen present in the exhaust gas for modifying the air/fuel ratio. The limitations on the use of the presently known sensors is that at cold start conditions the sensor, an electrochemical device, being cold has a high internal impedance and is therefore unable to function properly.

In order to avoid the misinformation which is developed by a cold sensor, some prior art closed loop systems provide several time delays that are activated upon actuation of the ignition to start the engine. The time selected for the time delay is generally that relating to "worst case" conditions. Thus, for each cold start condition, whether or not the actual temperature conditions warrant it, the time delay operates for the same, generally long, time. This results in an engine operation which may not be the most desirable in terms of economy and emission.

A. L. Oberstadt, in his co-pending patent application Ser. No. 510,276 U.S. Pat. No. 3,938,479 entitled "Exhaust Gas Sensor Operating Temperature Detection System" provides a system for generating an electrical control signal whenever the temperature of the sensor exceeds a predetermined level. However, in the complete control of a closed loop fuel injection system, other engine operating parameters must be considered which indicate that the engine and fuel management system are in condition for best operation.

SUMMARY OF INVENTION

A closed loop fuel injection system for an internal combustion engine has a control system for normalizing the fuel injection system to a fixed air/fuel ratio during predetermined operating conditions. The control system responds to the electrical information generated from several transducers to clamp the injection control unit to a fixed air/fuel ratio under these predetermined operating conditions. The transducers are respectively responsive to speed, engine coolant temperature, constituent gases of combustion and wide open throttle conditions and each generates an electrical signal indicating the condition.

The injection control unit operates according to the status of several inputs to the unit, to control the operate time of the injectors according to a predetermined schedule. Thus, in an engine starting operation the predetermined schedule may call for an air/fuel ratio which is different or richer than the air/fuel ratio for a cruise operation. The switching or indicating of the different operations is by means of the electrical intelligence gathered from or generated by various sensors or transducers.

In accordance with the control system hereinafter described, the normal scheduling of the injection control unit is clamped to a predetermined air/fuel ratio in accordance with intelligence gathered by the several sensors respecting engine operating conditions or engine rich fuel power demand conditions. Whenever any of these conditions are present, the primary and secondary integrators of the injection control unit have their electrical signal outputs clamped to a predetermined signal output. A change in the engine operating condition may be a cooling down of the gas sensor, or the reduction in engine speed while an engine rich fuel power demand condition may be wide open throttle operation or a cooling down of the engine coolant temperature.

DESCRIPTION OF DRAWINGS

In the drawings:

FIG. 1 is a block diagram of the control system responsive to a gas sensor;

FIG. 2 is a block diagram of the control system of FIG. 1 enlarged to include responses to engine operating conditions and to rich power demand conditions;

DETAILED DESCRIPTION

Figure 3:
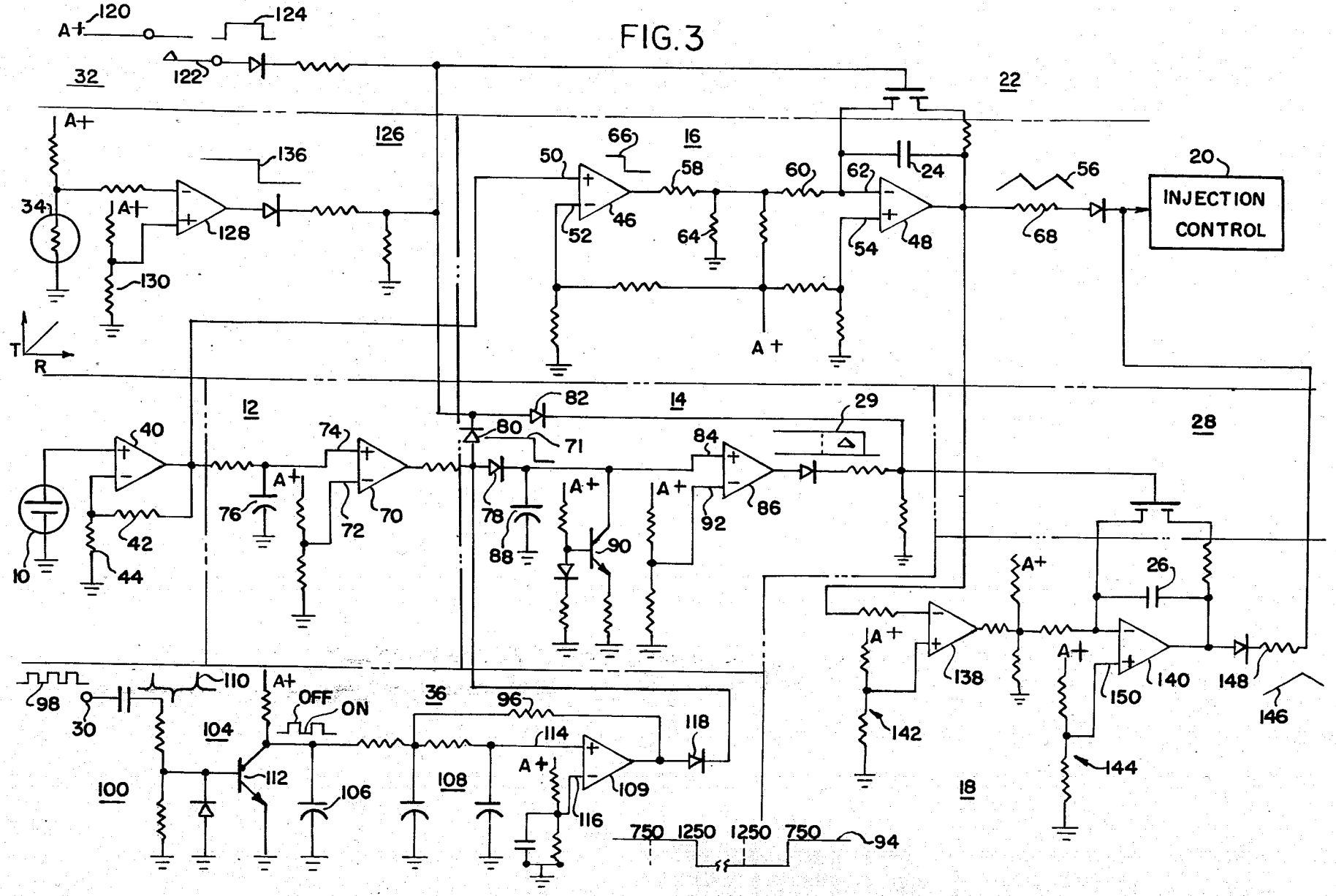
FIG. 3 is a schematic of the system of FIG. 2.

Referring to the Figures by the characters of reference there is illustrated in FIG. 1 in block diagrammatic form a control system for normalizing the air/fuel ratio of the fuel injection system. In a closed loop fuel injection system for an internal combustion engine, the air/fuel ratio is maintained at a predetermined ratio by means of the closed loop control in accordance with certain engine operations. It is necessary however under certain engine operating conditions to effectively by-pass the closed loop control and maintain the air/fuel ratio at a fixed value.

As illustrated in FIG. 1 the gas sensor 10, positioned in the combustion system of the engine, responds to the combustion gases and operates to close the control loop for maintaining the air/fuel ratio at a predetermined level. The gas sensor 10 of the preferred embodiment is an electrochemical gas sensor which must be at a high operating temperature such as 500° F in order to respond to a gas and generate an electrical signal. Until such sensor 10 is elevated to the high operating temperature, the voltage output of the sensor 10 is very small and for the purposes of information contains little or no intelligence. The reason for the very small voltage output at low temperatures is that the internal impedance of a cold sensor, approximately 30° to 40° F, is extremely high approaching the characteristics of an open circuit while its operating temperature, 500° F, the internal impedance of the sensor is approximately 1000 ohms.

In the system of FIG. 1 the gas sensor 10 is an oxygen gas sensor which is positioned in the exhaust system of an internal combustion engine. The sensor 10, an electrochemical transducer, responds to partial pressures of oxygen gas on either side of the sensor body and generates a voltage signal. When the sensor 10 is at its operating temperature it generates a voltage signal having a voltage range between 100 millivolts and one volt. In the absence of oxygen in the exhaust gas indicating a rich air/fuel ratio the voltage output of the sensor approaches one volt, and in the presence of oxygen indicating a lean air/fuel ratio, the voltage output of the sensor 10 approaches 100 millivolts.

The voltage output of the sensor 10 in FIG. 1 is electrically connected to a gas sensor amplifier means 12 for the purposes of amplifying the voltage output signal from the sensor 10. The output of the amplifier 12 is a high voltage level when the sensor's internal impedance is very high indicating that the sensor 10 is cold, or when the sensor is at its operating temperature and is generating a high output signal. When the sensor 10 warms up to its operating temperature the output of the amplifier 12 will switch between the high voltage level output and a low voltage level output in direct response to this electrical signal generated by the sensor.

The output signal from the amplifier means 12 is electrically connected to a delay means 14 which is responsive to a high voltage level signal on its input to generate a high output signal. When the output signal from the amplifier means 12 switches from its high to low voltage level, the delay means 14 extends the time of its output signal a predetermined time. The output signal from the gas sensor 10 is also electrically connected to a primary integrator circuit 16 of a fuel delivery control means. The fuel delivery control means provides the control authority for the operation of the fuel injectors by means of the injection control 20 in the fuel injection system. In the fuel delivery control means there is a primary and secondary integrator 16 and 18 which function together to provide an electrical signal to the injection control 20 for controlling the air/fuel ratio for the engine by means of controlling the amount of fuel supplied to the engine. The primary integrator 16 normally generates an electrical signal controlling the air/fuel ratio within a first control authority range, for example ± 5%, for normal engine operation. The secondary integrator 18 responds to the output signal of the primary integrator 16 and operates to extend the first control authority range during engine demand operations to about ± 20%.

A first switch means 22 is electrically connected in shunt or in parallel with the integrating capacitor 24 of the primary integrator 16 and when actuated operates to effectively short out the capacitor 24 thereby functionally changing the integrator to an amplifier having a predetermined output level. The actuating signal supplied to the first switch means 22 is the output signal of the gas sensor amplifier 12 and when said output is high the switch 22 is activated and the primary integrator 16 maintains its output at a predetermined level. This provides a fixed time control signal to the injector control unit 20.

Electrically connected in shunt with the integrating capacitor 26 of the secondary integrator 18 is a second switch means 28 which in a manner similar to the first switch means 22 operates to change the secondary integrator 18 from its integrator function to a fixed output amplifier function. The actuating signal for the second switch means 28 is the output signal 29 of the delay means 14 and therefore said second switch means 28 remains actuated for a time period determined by the delay means 14 after the output of the sensor amplifier means 12 switches from its high to its low voltage signal.

Thus the system of FIG. 1 is a control system within a closed loop fuel injection system to maintain control of the fuel injectors at a predetermined air/fuel ratio whenever the gas sensor 10 is electrically inoperative because the temperature of the sensor is below its operation temperature or the internal impedance of the sensor is extremely high.

Referring to FIG. 2 there is illustrated a block diagram of a system substantially similar to that of FIG. 1 but responsive to more engine operating conditions than that of FIG. 1. To the diagram of FIG. 1 there has been added three transducers 30, 32, and 34 which are responsive to engine speed, wide open throttle, and engine coolant and are functionally connected to control the operation of the primary and secondary integrators 16 and 18 of the fuel delivery control means. As in FIG. 1 the gas sensor 10 and amplifier means 12 are substantially identical to those of FIG. 1 and are interconnected in FIG. 2 in the same manner; namely, the output of the gas sensor 10 is logically connected to the amplifier means 12 and to the input of the primary integrator 16. The engine speed transducer means 30 is electrically connected to a speed transducer circuit means 36 and is responsive to the speed of the engine. To generate a pulse electrical signal having a pulse repetition frequency proportionate to the speed of the engine the speed transducer circuit means 36 generates a high voltage level when the speed of the engine is below a predetermined speed. Such a speed is typically the idle speed of the engine and therefore the output of the speed transducer circuit means 36 is a high or low signal indicating whether or not the engine is greater than or less than idle speed. The output of the speed transducer circuit means 36 is electrically connected with the output signal of the gas sensor amplifier means 12 in an "OR" function manner to the input to the delay circuit means 14 and also to actuate the first switch means 22 in shunt with the integrating capacitor 24 of the primary integrator 16.

For a particular set of engine operating conditions namely those which demand a rich fuel power operation, a wide open throttle transducer 32 and an engine coolant transducer 34 are additionally provided to the system of FIG. 2. The wide-open throttle transducer 32 is responsive to the wide-open position of the throttle of the engine and operates to generate a high voltage output signal in response thereto. The engine coolant transducer 34 is responsive to the coolant temperature of the engine and generates an electrical signal having a high voltage output whenever the coolant temperature is below a predetermined operating temperature. As illustrated in FIG. 2 the outputs of the two transducers 32 and 34 are electrically connected to actuate the first and second switch means 22 and 28. As in FIG. 1 whenever either of the first or second switch means 22 and 28 is actuated the corresponding integrator 16 or 18 is switched from an integrator to an amplifier inasmuch as the switch means electrically bypasses the integrating capacitor 24 and 26 of the integrator.

Referring to FIG. 3 there is illustrated a schematic of the circuit of FIG. 2 wherein each of the blocks of FIG. 2 are identified. As in the description of FIG. 2 the selection of high or low voltage levels is strictly dependent upon the circuit configuration and may be changed or altered in conformity thereto. It is the purpose and the function of the signal generated by each transducer and its associated circuitry which is pertinent to the disclosure herein.

As illustrated in FIG. 3 the gas sensor 10 is electrically connected to the noninverting input of an operational amplifier 40. The inverting input of the operational amplifier is biased with the output signal of the amplifier being divided by a pair of resistors 42 and 44. In effect the output signal from the operational amplifier is a signal having an amplitude equal to twice the amplitude of the sensor 10 when the resistors 42 and 44 are equal. This stage if a buffer stage and operates to provide the necessary power and impedance matching for the succeeding stages to which the signal is supplied.

As previously indicated the output of the gas sensor buffer stage is supplied to the primary integrator 16 comprising a first and second operational amplifier 46 and 48 electrically connected in cascade. The first operational amplifier 46 functions as a comparator and the second operational amplifier 48 functions as an integrator. The signal from the buffer stage is electrically supplied to the noninverting input 50 of the comparator 46. The inverting input 52 of the comparator 46 is biased at a voltage level representing the desired threshold voltage level of the sensor signal from the buffer amplifier 40. In the preferred embodiment an exhaust gas sensor 10 typically has a voltage swing from a normal operating condition between 200 and 800 millivolts and the threshold level is approximately 380 millivolts.

The integrator 48 has a biasing signal which is placed on its noninverting input 54 which is approximately midrange the signal output of the integrator 48. The voltage of the output signal of the integrator 48 has limits of 0 and 12 volts. Therefore, the bias level on the noninverting input 54 is adjusted for 6 volts. The sawtooth-shaped output signal 56 from the integrator 48 will modulate about the DC level of 6 volts. In normal engine operation such as a cruise condition, the output signal 56 of the primary integrator 16 typically has a total amplitude of approximately ½ volt peak-to-peak.

The output of the comparator 46 is electrically connected through first and second series resistors 58 and 60 to the inverting input 62 of the integrator 48. The first resistor 58 electrically connected to the output of the comparator 46 is adjusted to control the ramp rate of the output signal from the primary integrator 16. The effect of adjusting this resistor is to change the ramp rate of the output signal 56 in terms of volts per second but not the frequency of the signal. The second resistor 60 operates to control the current input to the integrator 48. A third resistor 64 electrically connected between ground and the output of the first resistor 58 is for adjusting the ramp rate of the rising portion of the output signal 56 to be equal to, more than, or less than the ramp rate of the falling portion of the output signal 56 of the integrator 48. In the preferred embodiment the output signal 66 of the comparator 46 is at either one of two voltage levels; namely, zero or the voltage represented by A+ which in the preferred embodiment is 9.5 volts. By the adjustment of the previous two identified resistors 58 and 64, the voltage at the midpoint of the two series resistors 58 and 60 is a half volt less than the bias level of the integrator 48 when the output of the comparator 46 is zero and is a half volt greater than the bias level when the output of the comparator 46 is A+. The integrating capacitor 24 is electrically connected between the output of the integrator 48 and the inverting input 62 thereof.

The resistor 68 electrically connected to the output of the integrator 48 controls the amount of current to the injection control 20 to provide the control authority for the multiplier circuit in the injection control means 20. The function of the current flowing through this resistor 68 is to provide control for the pulse width of the injector. This current changes in accordance with the change in voltage of the integrator 48, thereby changing the pulse width for the injector.

The output of the gas sensor buffer 40 is also electrically connected to an amplifier circuit 12 comprising an operational amplifier 70 wherein the output signal 71 of the amplifier 70 is a signal having either one of two voltage levels. In the preferred embodiment when the sensor 10 is cold, the output of the operational amplifier 70 is at a high voltage level. As the sensor 10 warms up the bias on the inverting input 72 exceeds the bias voltage level on the noninverting input 74 and the output of the amplifier 70 switches to a low voltage level. The function of the capacitor 76 which is electrically connected to the noninverting input 74 is to smooth out and store the signals coming out of the buffer 40. In normal operation, the output signal 71 of the operational amplifier 70 is low indicating that the sensor 10 is at its operating temperature. The normal switching of the gas sensor 10 due to the sensing of the gas operates to maintain the charge on the capacitor 76 below the biasing level on the inverting input 72 thereby the output of the operational amplifier 70 is low.

The output signal 71 of the operational amplifier 70 is electrically connected through a first diode 78 to the delay means 14 and through a second diode 80 for actuating first switch means 22 and also through the second diode 80 and a third diode 82 for actuating the second switch means 28. Therefore when the sensor 10 is below its operating temperature a high signal from the operational amplifier 70 will immediately actuate both the first and second switch means 22 and 28 and will drive the output signal 29 of the delay means 14 to a high voltage level or a disabling output signal.

The function and operation of the delay means 14 is described in copending application Ser. No. 510,276 to Allan L. Oberstadt entitled "Exhaust Gas Sensor Operating Temperature Detection System" and filed on Sept. 30, 1974 which is incorporated herein by reference. In that application, the circuit responds to the temperature of the gas sensor to generate an output signal; however, in this application the delay means 14 is responsive to two different engine operating signals and operates to maintain a disabling output electrical signal 29 for a period of time beyond the cessation of both engine operating signals. One input signal to the delay means 14 is received from the operational amplifier 70 of the sensor amplifier 12 and is gated through the first diode 78 to the noninverting input 84 of an operational amplifier 86, to a storage capacitor 88 and to the collector of a transistor 90. The bias level connected to the inverting input 92 of the operational amplifier 86 in the delay means 12 represents a voltage level intermediate the high and low level of the output signal 71 of the sensor amplifier means 12.

In the delay means 14, the function of the transistor 90 and its associated base circuit is to provide a discharge path through the collector-emitter circuit of the transistor 90 for the capacitor 88 to discharge the voltage level on the capacitor 88 at a controlled rate thereby providing the delay time of the delay means 14. Thus, when the capacitor 88 is fully charged to the high voltage signal from the sensor amplifier 12 at the input to the first diode means 78, the output signal 29 from the operational amplifier 86 of the delay means 14 is a high voltage signal. When the input signal 71 switches to its low voltage level the storage capacitor 88 begins to discharge through the transistor 90 maintaining the voltage at the input to the noninverting input 84 of the operational amplifier 86 greater than the bias level on the inverting input 92 for the delay time.

The second engine operating signal supplied to the delay means 14 is a signal 94 representing the speed of the engine. In the preferred embodiment this signal is a high voltage signal below a first speed of 750 rpm and remains high through a feedback network 96 as the speed is increased to a second speed of approximately 1250 rpm where the signal switches to a low voltage signal. However, when the engine is being slowed down from a speed greater than the second speed, the output signal 94 remains low until the first speed is reached.

The engine speed conditions are generated from a speed transducer 30 which is responsive to the rotational speed of the engine and is operable to generate a pulsed electrical signal 98 having a pulse repetition rate proportional to the speed of the engine. This pulsed electrical signal 98 is electrically connected to a speed transducer circuit means 26 to generate the second engine operating signal 94.

The speed transducer circuit means comprises a high pass filter 100, storage control means 104, a storage means 106, a low pass filter 108, a comparator 109 and a feedback resistor 96. The pulsed electrical signal 98 is applied to the high pass filter means 100 for differentiation 110. The differentiated signal is then clipped to remove the negative signal and the positive signal is applied to a transistor 112 in the storage control means 104. When the transistor 112 is conducting the storage means 106 is discharged through the transistor 112 and when the transistor is not conducting, the storage means is charged.

The voltage signal on the storage means 106 is processed through the low pass filter 108 to the noninverting input 114 of the comparator 109. The signal on the noninverting input 114 will be greater than the bias voltage on the inverting input 116 when the engine speed is below 750 rpm. The output signal 94 of the comparator 114, the second engine operating signal, is electrically connected through a diode 118 to the first diode 78 of the delay means 14 and also through the feedback resistor 96 to the low pass filter means 108 thereby providing circuit hysteresis for the speed transducer circuit means 36.

The bias voltage on the inverting input 116 of the comparator 109 represents the first speed. It has been found that when an engine is in idle the temperature of the gas sensor 10 decreases and the information generated by the sensor tends to cause the engine to lean out thereby causing the engine speed to decrease further to a stall condition. The first speed of 750 rpm being below idle speed was selected to avoid unnecessary reaction of the circuit 36 due to gear shifting and deceleration of the vehicle.

When the second engine operating signal 94 is generated and the first and second switch means 22 and 28 are clamped, the control from the primary integrator 16 and the secondary integrator 18 will cause the engine speed to increase to approximately 850 rpm.

In FIG. 2, the rich power demand conditions are indicated by either a wide open throttle condition or the temperature of the engine coolant. During these conditions, the information generated by the gas sensor 10 would cause the fuel injection system to operate the engine in a mode opposite to rich power demand conditions, therefore under these conditions, the first and second switch means 22 and 28 are actuated and the outputs of the primary and secondary integrators 16 and 18 clamped to the predetermined operating condition.

On FIG. 3, the wide open throttle condition is sensed by a wide open throttle transducer 22 comprising a source of voltage 120 and a normally open switch 122. The switch 122 is actuated from throttle valve of the engine and closes when the throttle is wide open indicating an acceleration or high power engine operation. The signal 124 generated by the closing of the switch 122 is electrically connected to actuate the first switch means 22 and through the third diode means 82 to actuate the second switch means 28. Because this is a temporary condition, the delay means 14 is not energized and the first and second switch means 22 and 28 are deactivated when the throttle is returned from the wide open condition.

When the engine coolant is below a predetermined operating temperature, the engine is operated in a rich mode in order to overcome high engine friction and poor fuel prepartion. The temperature of the coolant is measured by a transducer 34 which is responsive to the coolant temperature and generates an electrical signal proportional thereto. This electrical signal is electrically connected to a coolant transducer circuit means 126 comprising a comparator 128 and a bias circuit 130. In the embodiment shown the temperature transducer 34 has a positive temperature coefficient in that as the temperature increases, the resistance increases.

The bias circuit 130 is a voltage divider wherein the output voltage is electrically connected to the noninverting input 132 of the comparator 128. The output voltage of the bias circuit represents a predetermined temperature such as 100° F. The inverting input 134 of the comparator 128 receives the signal from the coolant transducer 34 and the output signal 136 of comparator 128 is a high voltage level when the coolant is below the predetermined temperature and is a low voltage level above the predetermined temperature.

The signal from the coolant transducer circuit 126 is electrically connected to actuate the first and second switch means 22 and 28 in a manner identical to that described for the wide open throttle transducer 32. Once the coolant temperature is above the predetermined temperature, the operation of the engine should maintain the temperature, however if for some reason the engine coolant transducer 34 indicates the temperature has dropped, the first and second switch means 22 and 28 will be actuated.

The secondary integrator 18 comprises a comparator 138, an integrator 140 and bias means 142 and 144 associated with each. The output signal 146 from the secondary integrator 18 is electrically combined with the output signal 56 from the primary integrator 16 and provides the control authority for the operation of the fuel injectors in the fuel injection system. The output signal 56 from the primary integrator 18 has a time constant of approximately two seconds. In this time the output signal 56 will ramp either up or down from one limit to the other. This, in the preferred embodiment, provides a control authority of approximately five percent. This means that depending upon the information generated by gas sensor 10, the element closing the control loop, the operation of the injectors will be varied five percent. The output signal 56 from the primary integrator 16 is electrically connected to the secondary integrator 18 and processed therethrough in a manner identical to the signal processing of the primary integrator 16. The output signal from the secondary integrator 18 has a time constant of approximately forty seconds. In this time the output signal 146 will ramp either up or down from one voltage limit to the other.

In a typical operation, the output of the primary integrator 16 is a triangular shaped voltage signal 56 having a D.C. level as determined by the bias voltage on the noninverting input 54 and an amplitude voltage swing of 0.5 volts. This results in a signal output that is very close to a D.C. level. At lean fuel condition, the output signal 56 of the primary integrator 16 reaches one voltage limit in one second and the output signal 146 of the secondary integrator 18 ramps in the same direction but at a much slower rate. As previously indicated these two signals 56 and 146 are electrically combined and supplied to the injector control unit 20, thereby increasing the control range from five percent to eighteen percent. The combining of these signals is by the addition of the current generated through the two output resistors 68 and 148 of the primary and secondary integrators 16 and 18.

The bias level on the integrator 140 in the secondary integrator 18, the voltage level on the noninverting input 150, is typically set to a voltage level which is greater than the midvoltage range of the output signal 146 of the integrator 140. The reasoning is that typically an engine is at altitudes above sea level more than at below sea level conditions. However, this is an adjustable setting and depends on the conditions in which the engine is most operated.

At altitudes, the less dense air causes the fuel mixture to enrich. The gas sensor 10 senses this rich condition and orders the primary integrator 16 to lean out. This lean out signal output 56 from the primary integrator 16 is sensed by the secondary integrator 18 and its output signal 146 ramps in the same direction.

With the system as shown, an engine may be cold started at a high altitude. In this condition the first and second switch means 22 and 28 are actuated and the fuel injection system will cause the fuel supplied to the engine to be rich allowing the engine to start. This condition remains longer at an altitude because if the gas sensor 10 is an oxygen gas sensor, the sensor does not reach its operating temperature as fast as it does at sea level conditions.

There has thus been shown and described a control system for use in a closed loop fuel injection system for an internal combustion engine to normalize the fuel/air ratio to a fixed predetermined ratio during predetermined engine operating conditions or rich fuel demand conditions. In the preferred embodiment these conditions are defined by an operating characteristic of a gas sensor, the speed of the engine, the wide open throttle position and the temperature of the engine coolant.

We claim:

1. In a closed loop fuel injection system for an internal combustion engine, a control system for normalizing the fuel injection system to a fixed air/fuel ratio during predetermined operating conditions, said control system comprising:

an electrochemical gas sensor positioned in the combustion system of the engine and operable at a high sensor temperature to generate a first voltage signal in response to the presence of a predetermined constituent gas and to generate a second voltage signal in response to the absence of a predetermined constituent gas, said sensor having an internal impedance varying inversely with the temperature of said sensor from a very high internal impedance at its low nonoperable temperature to a very low internal impedance at its high operating temperature;

a gas sensor amplifier circuit means electrically connected to said sensor, said circuit means normally having a high voltage level output signal when said sensor's internal impedance is very high corresponding to the low temperature of said sensor and adapted to switch said output signal between said high voltage level and a low voltage level in response to said first and second voltage signals from said sensor;

delay means responsive to said high voltage level output signal from said gas sensor amplifier circuit means for generating an output voltage signal and operative in response to the switching of said output signal from said amplifier circuit means from said high to said low voltage level for maintaining said output voltage level output signal for an extended predetermined period of time;

fuel delivery control means for providing the control authority for operation of the fuel injectors, said means including primary and secondary integrators, said primary integrator normally generating an electrical signal for controlling the air/fuel ratio within a first control authority range for normal engine operation in response to said first and second voltage signals from said sensor and operative to generate an electrical signal for controlling the air/fuel ratio to a fixed air/fuel ratio and said secondary integrator normally responsive to said primary integrator for increasing said first control authority range during engine demand operation outside of normal engine operation;

a first switch means electrically connected in shunt with the integrating capacitor of said primary integrator and responsive to said high voltage level output signal from said sensor amplifier circuit means to maintain said fixed air/fuel ratio; and a second switch means electrically connected in shunt with the integrating capacitor of said secondary integrator and responsive to said output signal from said delay means for maintaining said primary integrator within said first control authority range.

2. In the control system according to Claim 1 additionally including a speed transducer responsive to the speed of the engine and operable to generate a pulsed electrical signal having a frequency proportional to the speed of the engine; and speed transducer circuit means responsive to said pulsed electrical signal for generating an output signal having a high voltage level below a first speed and a low voltage level above a second speed, said high output signal operable for activating said delay means and said first and second switch means.

3. In the control system according to claim 2 wherein said first speed is below the idle speed of the engine and said second speed is greater than the idle speed of the engine.

4. In the control system according to claim 3 wherein said speed transducer circuit means includes a feedback means for maintaining said output signal at a said high voltage as the speed is increased from said first to said second speed and for maintaining said output signal at said low voltage level as the speed is decreased below said second speed.

5. In the control system according to claim 1 additionally including an engine coolant transducer responsive to the coolant temperature of the engine for generating an electrical signal proportional thereto, and coolant transducer circuit means responsive to said electrical signal for generating an output signal having a high voltage level when the coolant is below a predetermined temperature and switching to a low voltage above said predetermined temperature, said high output voltage signal operable for activating said first and second switch means.

6. In the control system according to claim 1 additionally including wide open throttle transducer means responsive to the wide open position of the throttle of the engine for generating an output signal having a high voltage level, said high voltage level operable for activating said first and second switch means.

7. In the control system according to claim 1 wherein said first control authority range operates to maintain the air/fuel ratio substantially at stoichiometric air/fuel ratio conditions and said secondary integrator operates to increase said first control authority range by at least a factor of three.

8. In the control system according to claim 7 wherein said first control authority range is five percent and said second integrator increases said first control authority range by eighteen percent thereby allowing the engine to operate with air/fuel ratios having values from substantially 12 to substantially 18.

9. In a closed loop fuel injection system for an internal combustion engine, control system for normalizing the fuel injection system to a fixed air/fuel ratio during predetermined operating conditions, said control system comprising:

an electrochemical exhaust gas sensor positioned in the exhaust system of the engine, said sensor having an internal impedance varying inversely with the temperature of said sensor from a very high internal impedance at its low, nonoperable temperature to a very low internal impedance at its high, operating temperature;

a gas sensor amplifier circuit means electrically connected to said sensor, said circuit means responsive to the change in internal impedance thereof for generating an output signal having a high voltage level in response to said very high internal impedance;

speed transducer means responsive to speed of the engine and operable to generate a pulse electrical signal having a frequency proportional to the speed of the engine;

speed transducer circuit means responsive to said pulse electrical signal for generating an output signal having a high voltage level below a first speed;

a delay means receiving as its input signal said high voltage output signal from said gas sensor amplifier circuit means and said speed transducer circuit means for generating a high voltage level output signal in response thereto and for maintaining said high voltage level output signal for an extended predetermined period of time after said signals are removed from the input of said delay means;

an engine coolant transducer responsive to the coolant temperature of the engine for generating an electrical signal having a high voltage level below a predetermined operating temperature;

wide open throttle transducer means responsive to the wide open position of the throttle of the engine for generating a high voltage output signal;

fuel delivery control means including primary and secondary integrators each respectively having an integrating capacitor, said primary integrator normally maintaining a first air/fuel ratio and operative to maintain a second fixed air/fuel ratio and said secondary integrator normally responsive to said primary integrator for modifying said first air/fuel ratio;

a first switch means electrically connected in shunt with said integrating capacitor of said primary integrator and responsive to one of said high voltage level output signals from said sensor amplifier circuit means, said speed transducer means, said wide open throttle transducer means, and said engine coolant transducer means; and a second switch means electrically connected in shunt with said integrating capacitor of said secondary integrator and responsive to said high voltage output signal from said delay means for maintaining the output of said primary integrator unmodified.

* * * * *

UNITED STATES PATENT OFFICE

CERTIFICATE OF CORRECTION

Patent No. 3,990,411 Dated November 9, 1976

Inventor(s) Allan Lee Oberstadt, Alvin Dan Toelle, Gene Y. Wen

It is certified that error appears in the above-identified patent and that said Letters Patent are hereby corrected as shown below:

ON THE ABSTRACT PAGE:

After the word "Inventors" insert the name and place ---Allan Lee Oberstadt, Rochester;---

After the word "Assignees:" delete ---Gene Y. Wen, Troy, all of Mich.:---

Signed and Sealed this

Eighth Day of March 1977

[SEAL]

*Attest:*

RUTH C. MASON
*Attesting Officer*

C. MARSHALL DANN
*Commissioner of Patents and Trademarks*